US007669718B1

(12) United States Patent
Patty

(10) Patent No.: US 7,669,718 B1
(45) Date of Patent: Mar. 2, 2010

(54) CONVERTIBLE DISPLAY FIXTURE

(76) Inventor: Harry Patty, 7155 S. Parkside Dr., Tempe, AZ (US) 85283

( * ) Notice: Subject to any disclaimer, the term of this patent is extended or adjusted under 35 U.S.C. 154(b) by 685 days.

(21) Appl. No.: 11/611,007

(22) Filed: Dec. 14, 2006

Related U.S. Application Data

(60) Provisional application No. 60/750,663, filed on Dec. 14, 2005.

(51) Int. Cl.
*B65D 25/54* (2006.01)
*B65D 8/14* (2006.01)
*A47F 5/10* (2006.01)
*E04H 1/12* (2006.01)

(52) U.S. Cl. ..... 206/774; 206/600; 206/748; 206/766; 211/199; 220/4.29; 220/6; 312/5; 312/6

(58) Field of Classification Search ..... 206/600, 206/736, 747–749, 766, 774; 211/175, 194, 211/195, 198, 199; 220/1.5, 4.28, 4.29, 6, 220/7; 312/3–6
See application file for complete search history.

(56) References Cited

U.S. PATENT DOCUMENTS 5,323,921 A * 6/1994 Olsson ..... 220/6
5,593,046 A * 1/1997 Katsuura et al. ..... 211/175
5,833,114 A * 11/1998 Linnell ..... 220/6
5,904,262 A * 5/1999 Coppi ..... 220/7
5,950,836 A * 9/1999 Iwamoto et al. ..... 206/600
6,032,815 A * 3/2000 Elstone ..... 220/6
6,182,849 B1 * 2/2001 Elstone, Sr. ..... 220/6
6,305,764 B1 * 10/2001 Kortman et al. ..... 312/3
6,422,409 B2 * 7/2002 Kofod ..... 220/7
6,547,084 B2 * 4/2003 Bauman et al. ..... 211/71.01
6,601,928 B1 * 8/2003 Kortman et al. ..... 312/3
6,726,046 B2 * 4/2004 Orset ..... 220/7
6,811,048 B2 * 11/2004 Lau ..... 220/1.5
6,913,161 B2 * 7/2005 Schafer ..... 220/6
7,520,390 B2 * 4/2009 Sonon ..... 206/774

* cited by examiner

*Primary Examiner*—Bryon P Gehman

(57) ABSTRACT

A convertible display fixture comprising: a top portion; a front portion coupled to the top portion; at least one side portion coupled to the front portion; a back coupled to the at least one side portion; a bottom portion coupled to the front portion; wherein the top portion, the at least one side portion, the back portion, the bottom portion and the front portion form a shipping container; and wherein the top portion, the at least one side portion, the back portion and the bottom portion collapse towards the front portion to form a display fixture. In alternate embodiments, the convertible display fixture further comprises a collapsible lock box coupled to the front portion and top portion. Other embodiments further comprise at least one skid and at least one wheel coupled to the bottom portion.

20 Claims, 13 Drawing Sheets

CONVERTIBLE DISPLAY FIXTURE

CROSS-REFERENCE TO RELATED APPLICATIONS

This application claims priority to U.S. Provisional Application No. 60/750,663, filed on Dec. 14, 2005 by the same inventor, the contents of which are incorporated herein by reference.

BACKGROUND OF THE INVENTION

1. Technical Field

This invention relates to a display fixture which converts to a shipping configuration for transportation.

2. Background Art

Trade show demonstrators generally need to transport their trade show goods and demonstration material such as banners and other types of signs to trade shows scattered around the country. Trade show demonstrators typically use large shipping containers to transport their trade show goods, brochures, literature, tools and demonstration materials to the location of trade shows.

Upon arrival at a trade show, the trade show demonstrator generally is required to have the shipping containers moved to a separate location after unloading the cargo from the containers. After the end of the trade show, the demonstrator must wait for the shipping container to be returned before the demonstrator can reload the demonstration materials into the shipping container. Often, the demonstrator must wait for an extended period before the shipping container will be returned so they can pack up the trade show goods and/or demonstration materials and leave the trade show location.

Furthermore, trade show demonstrators often need to use display fixtures such as tables and other types of stands to hold trade goods, literature or banners at the trade show. These display fixtures may also need to be transported to the trade show location.

Accordingly, what is needed is a convertible display fixture which acts as a stand or table at the trade show location and can further be converted to a shipping configuration in order to act as a shipping container to hold trade goods, literature, banners and the like for transport.

DISCLOSURE OF THE INVENTION

The present invention may be readily adapted to a variety of display fixtures for trade shows or other uses. Embodiments of the present invention may provide, among other benefits: the ability of the trade show demonstrator to quickly and easily convert a display fixture to a configuration for shipping in which the display fixture acts to contain trade goods, literature or banners for transport. Furthermore, embodiments of the present invention may provide the advantage of allowing a trade show demonstrator to use a converted display fixture for shipping in order to avoid the need for shipping containers which must be moved to a separate location while the trade show demonstrator is at the trade show. Embodiments of the present invention may further provide the benefit of allowing the trade show demonstrator to quickly and easily collapse a shipping container into a display fixture for use at a trade show.

A convertible display fixture, configured according to the present invention, comprises: a top portion comprising a plurality of top panels hingedly coupled to each other; a front portion comprising at least one front panel, wherein the front portion is hingedly coupled to at least one of the plurality of top panels; at least one side portion comprising a plurality of side panels hingedly coupled to each other, wherein the at least one side portion is coupled to the front portion; a back portion comprising a plurality of back panels coupled to each other, wherein at least one of the plurality of back panels is hingedly coupled to at least one of the plurality of side panels; a bottom portion comprising a plurality of bottom panels hingedly coupled to each other, wherein the bottom portion is coupled to the front portion; wherein the top portion, the at least one side portion, the back portion, the bottom portion and the front portion form a shipping container; and wherein the top portion, the at least one side portion, the back portion and the bottom portion collapse towards the front portion to form a display fixture.

Alternate embodiments of a convertible display fixture configured according to the present invention, comprise: a top portion comprising a plurality of top panels hingedly coupled to each other; a front portion comprising a plurality of front panels coupled to each other, wherein the front portion is coupled to at least one of the plurality of top panels; at least one side portion comprising a plurality of side panels hingedly coupled to each other, wherein the at least one side portion is coupled to the front portion; a back portion comprising a plurality of back panels coupled to each other, wherein at least one of the plurality of back panels is hingedly coupled to at least one of the plurality of side panels; a bottom portion comprising a plurality of bottom panels hingedly coupled to each other, wherein the bottom portion is coupled to the front portion; wherein the top portion, the at least one side portion, the back portion, the bottom portion and the front portion form a shipping container when in a shipping configuration; and wherein the top portion, the at least one side portion, the back portion, the front portion and the bottom portion collapse to form a plurality of display fixtures when in a display fixture configuration.

Other embodiments of a convertible display fixture configured according to the present invention, comprise: a top portion comprising a plurality of top panels hingedly coupled to each other; a front portion comprising at least one front panel, wherein the front portion is hingedly coupled to at least one of the plurality of top panels; at least one side portion comprising a plurality of side panels hingedly coupled to each other, wherein the at least one side portion is coupled to the front portion; a back portion comprising a plurality of back panels coupled to each other, wherein at least one of the plurality of back panels is hingedly coupled to at least one of the plurality of side panels; a bottom portion comprising a plurality of bottom panels hingedly coupled to each other, wherein the bottom portion is coupled to the front portion; a collapsible lock box coupled to the front portion and top portion, comprising at least one side panel hingedly coupled to the front portion, a bottom panel hingedly coupled to the front portion and detachably coupleable to the at least one side panel; a lower front panel hingedly coupled to the bottom panel and detachably coupleable to the at least one side panel, an upper front panel hingedly coupled to the lower front panel, a locking mechanism coupled to the upper front panel and coupleable to the top portion; wherein the top portion, the at least one side portion, the back portion, the bottom portion and the front portion form a shipping container when in a shipping configuration; and wherein at least the top portion, the at least one side portion, the back portion and the bottom portion collapse to form a display fixture when in a display fixture configuration.

Convertible display fixtures configured according to embodiments of the present invention may also comprise at least one skid coupled to the bottom portion for use in handling of the convertible display fixture when in the shipping configuration. Embodiments may further comprise at least one wheel coupled to the bottom portion which are accessible only in the display fixture configuration and allow a user to easily move the convertible display fixture in display fixture configuration.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

As discussed above, embodiments of the present invention relate to a convertible display fixture which converts from a display fixture configuration to a shipping configuration or collapses from a shipping configuration to a display fixture. In display fixture configuration, the convertible display fixture can be used as a table or a stand for materials such as those used in a trade show. In shipping configuration, the convertible display fixture is a shipping container which may be used to hold materials or goods shipped to or from a trade show or the like. Generally, a convertible display fixture comprises at least a plurality of panel pieces joined together by hinges, fasteners, or other means of securing panel pieces to each other.

Figure 1:
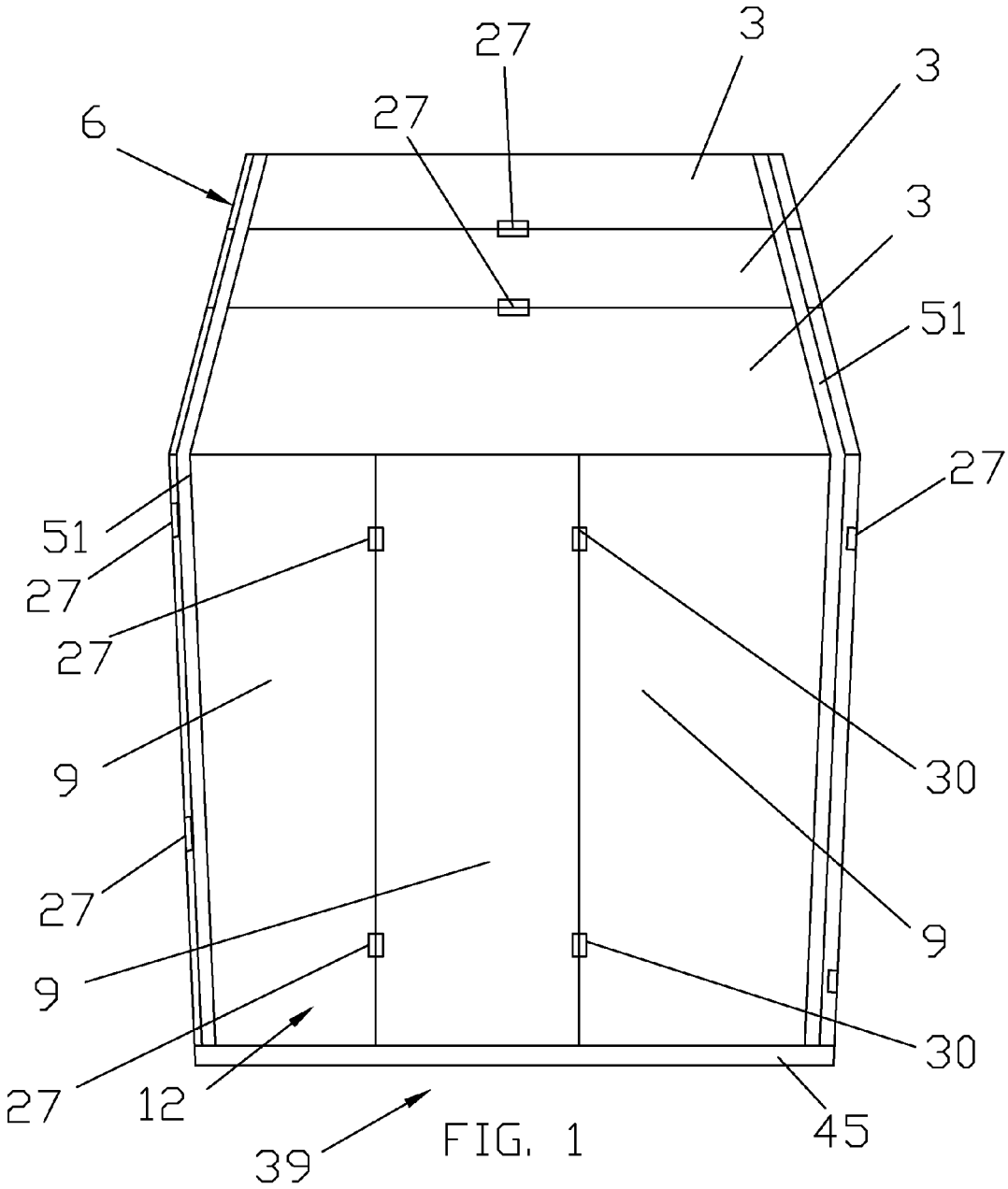
FIG. 1 is a perspective view of a back of a first embodiment of a convertible display fixture configured according to an embodiment of the present invention in a shipping configuration.
Figure 2:
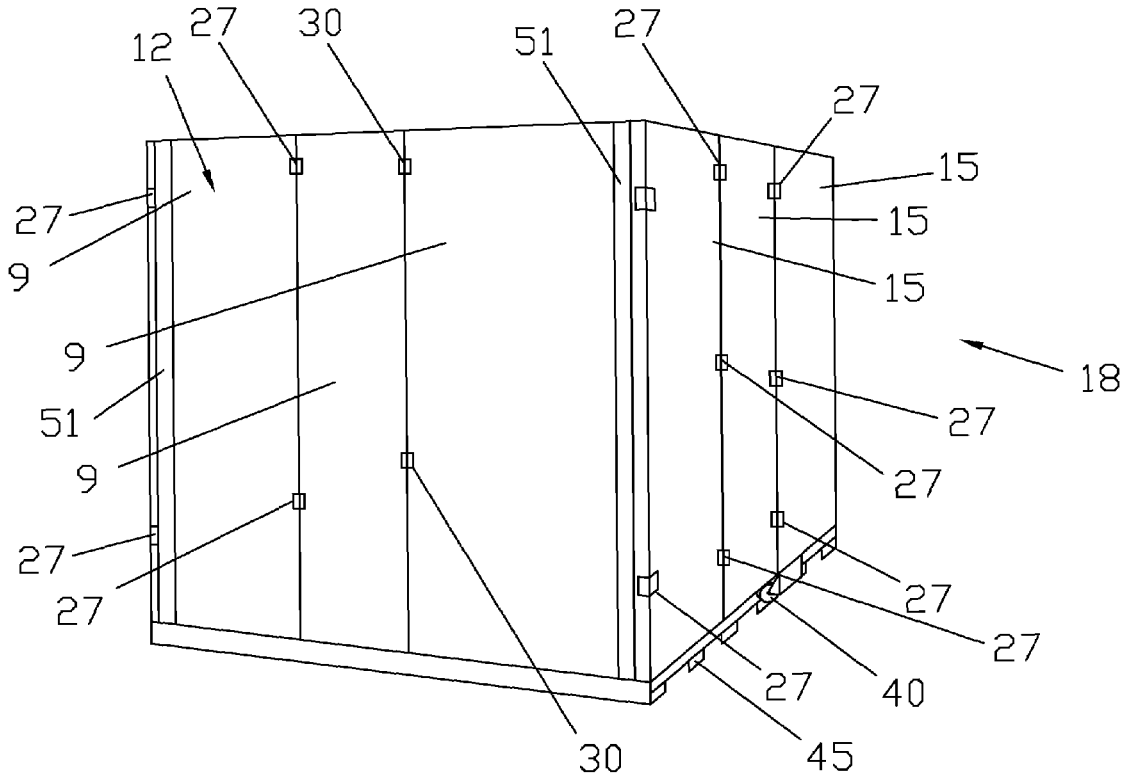
FIG. 2 is a back perspective view of the first embodiment of a convertible display fixture configured according to an embodiment of the present invention in the shipping configuration.

As illustrated in FIGS. 1-2, an embodiment of the present invention as viewed in shipping configuration comprises a top portion 6 comprising at least one top panel 3 and a back portion 12 comprising at least one back panel 9. The embodiment of the present invention further comprises at least one side portion 18 comprising at least one side panel 15, a front portion 21 comprising at least one front panel 24 (See FIG. 8) and a bottom portion 39 comprising at least one bottom panel 42 which is coupled to the front portion 21 (See FIG. 5).

In a first embodiment of the present invention, the top portion 6 comprises a plurality of top panels 3. The plurality of top panels 3 are hingedly coupled 27 to each other to allow the top portion 6 to be folded towards front portion 21 (See FIGS. 3 and 4). At least one side portion 18 comprises a plurality of side panels 15. A back portion 12 comprises a plurality of back panels 9. At least one of the plurality of back panels 9 is hingedly coupled 27 to at least one of the plurality of side panels 15. At least two of the plurality of back panels 9 are detachably coupled 30. The first embodiment further comprises a front portion 21 comprising at least one front panel 21 (See FIG. 8). At least one of the plurality of side panels 15 is coupled to the front portion 21. A bottom portion 39 comprises a plurality of bottom panels 42 which bottom portion 39 is coupled to the front portion 21.

Figure 3:
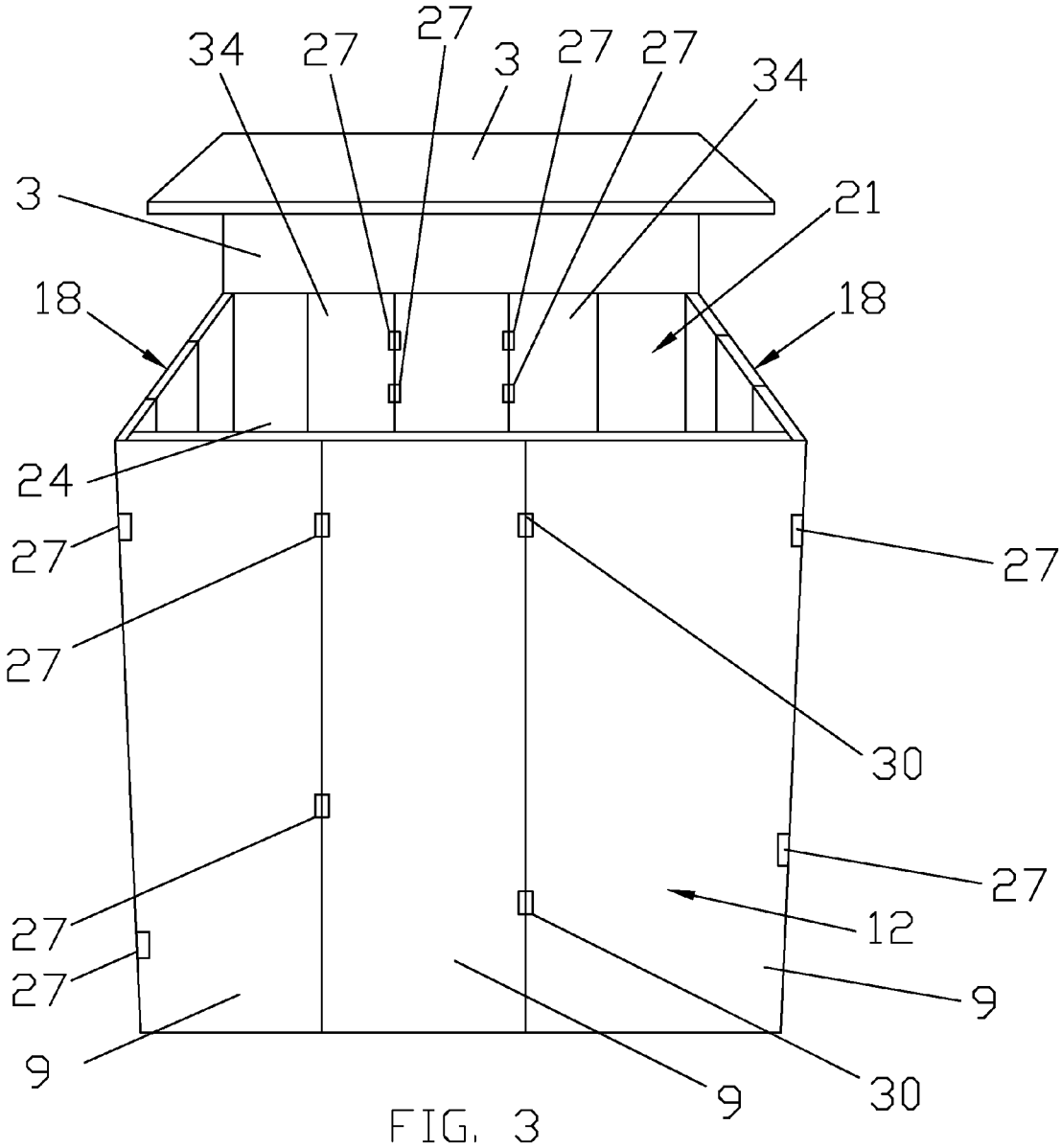
FIG. 3 is a back perspective view of the first embodiment of a convertible display fixture configured according to an embodiment of the present invention in the shipping configuration with a top panel being collapsed.
Figure 4:
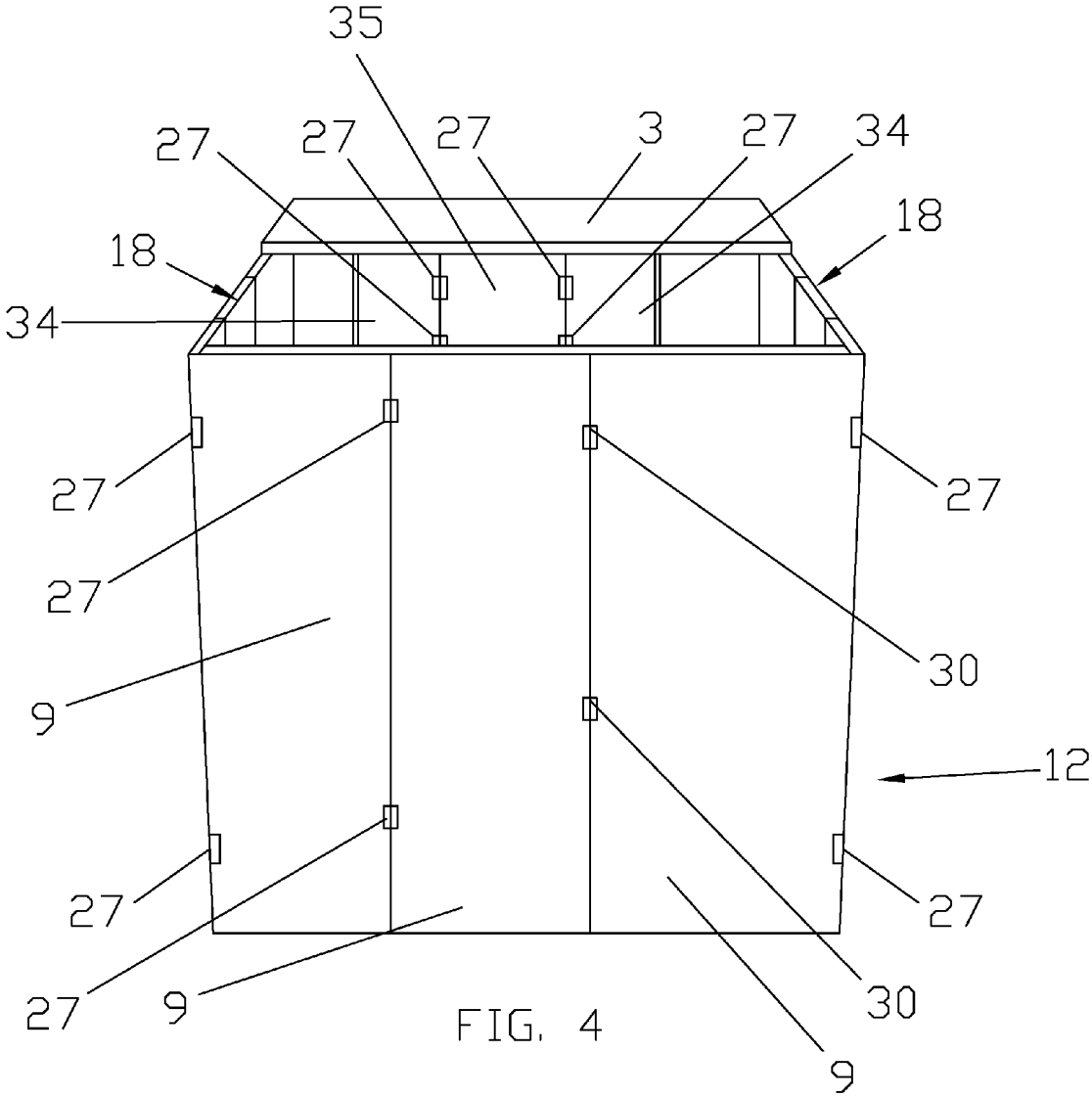
FIG. 4 is a perspective view of the first embodiment of a convertible display fixture configured according to an embodiment of the present invention in the shipping configuration with a collapsed top panel.
Figure 5:
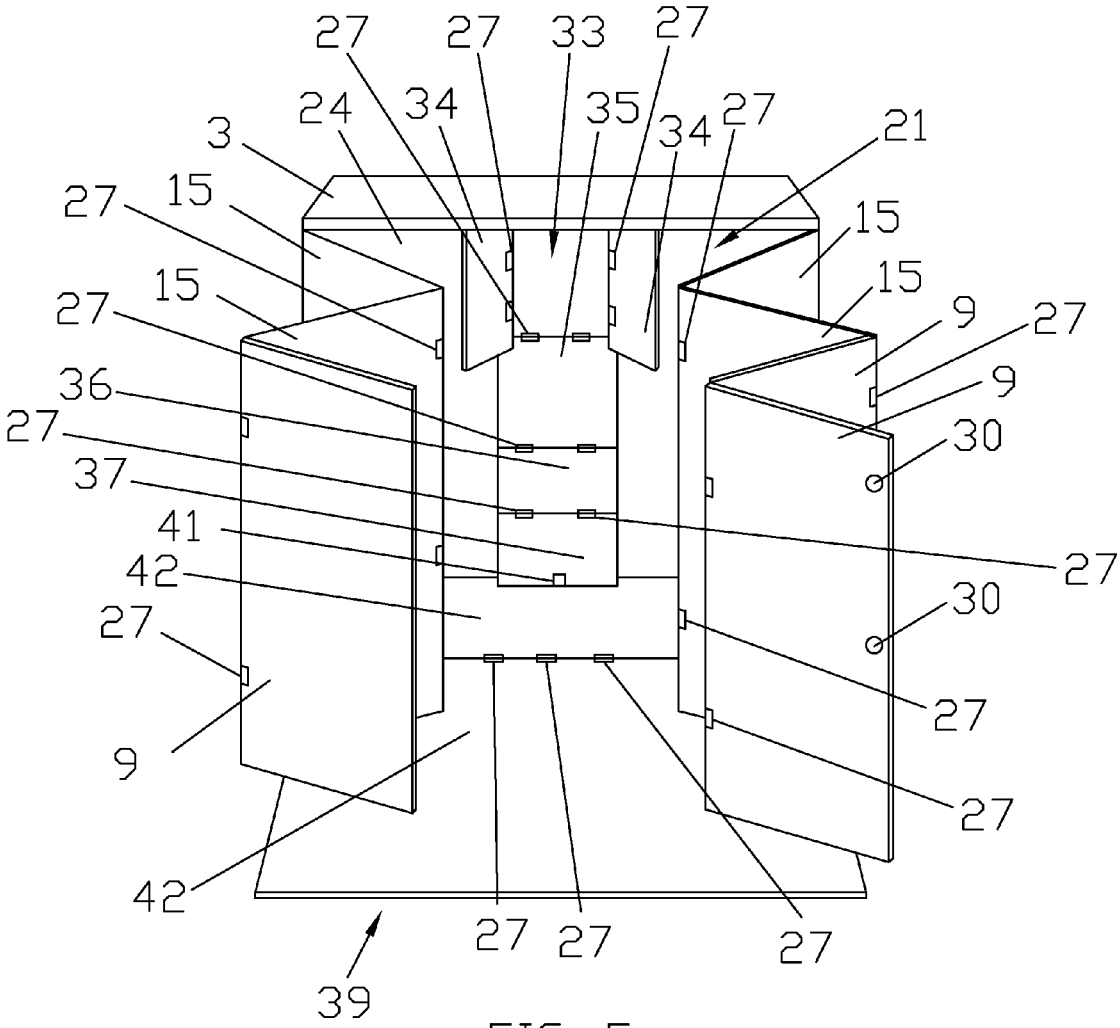
FIG. 5 is a back view of the first embodiment of a convertible display fixture configured according to an embodiment of the present invention in which the convertible display fixture is in the process of being collapsed from the shipping configuration, with the back open, a lock box completely collapsed, and the sides being collapsed.
Figure 6:
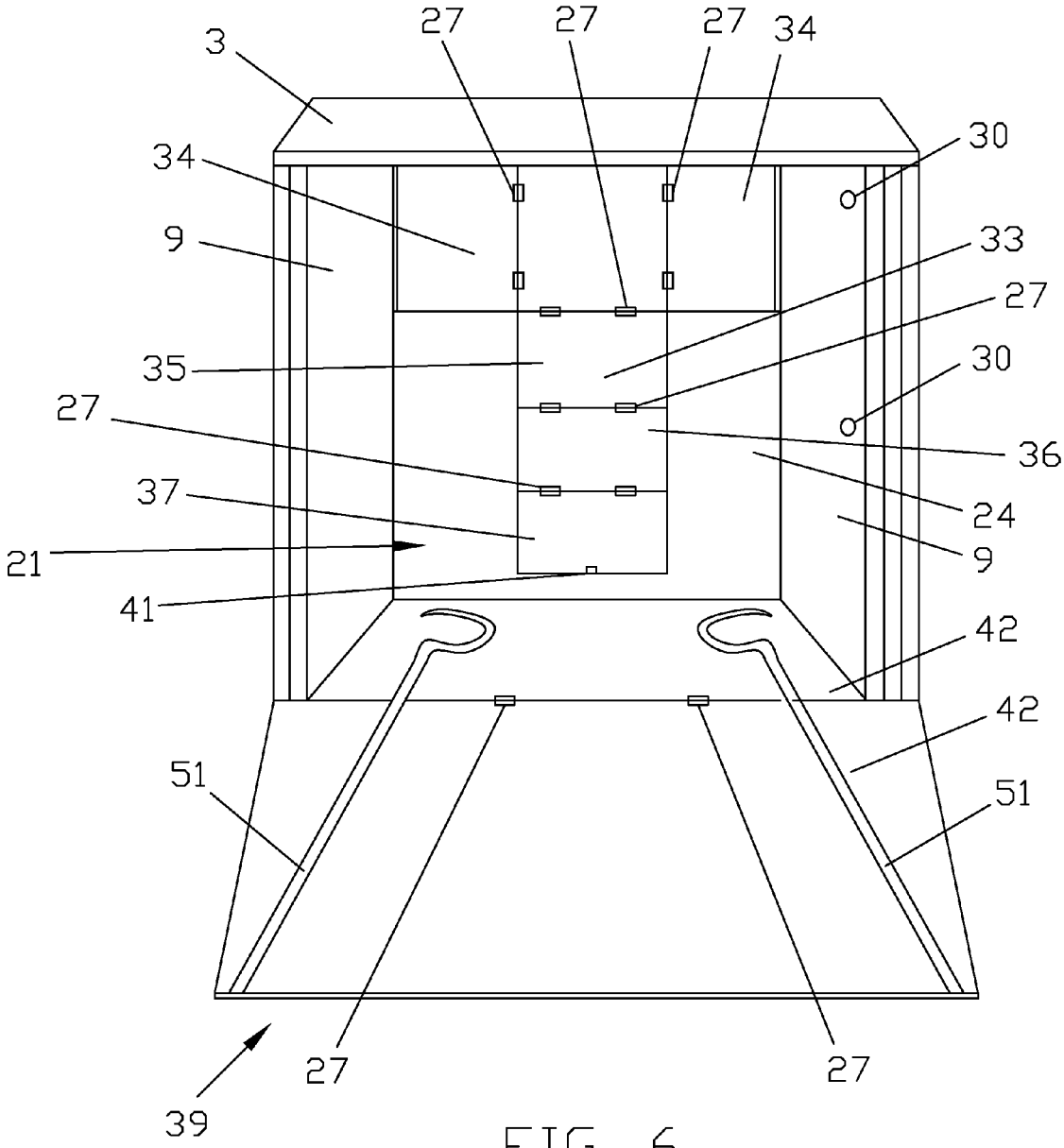
FIG. 6 is a back view of the first embodiment of a convertible display fixture configured according to an embodiment of the present invention in which the convertible display fixture is in the process of being collapsed from the shipping configuration, with the back open and lock box completely collapsed and sides collapsed.
Figure 8:
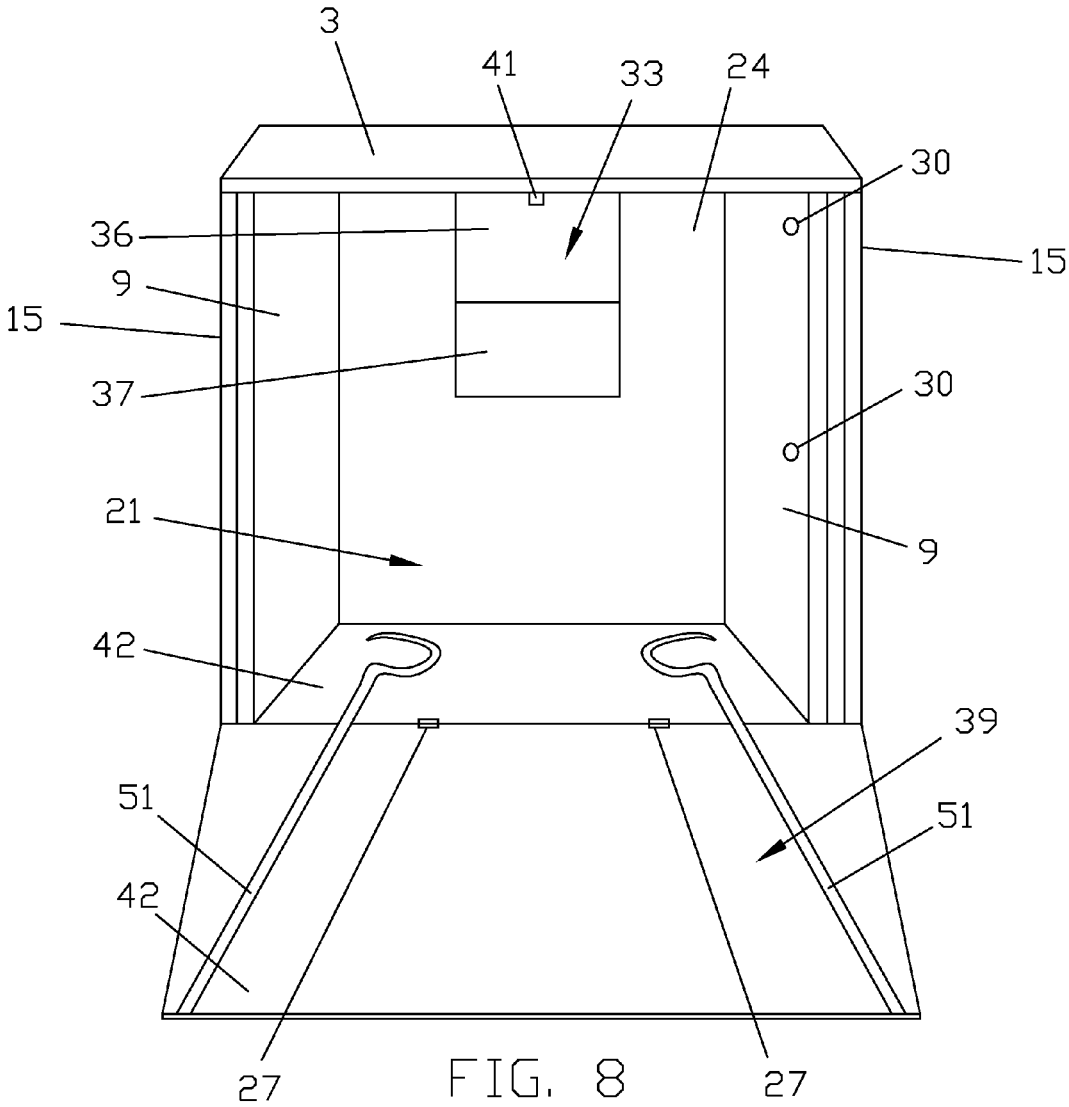
FIG. 8 is a back view of the first embodiment of a convertible display fixture configured according to an embodiment of the present invention in the display fixture configuration with the back open and the lock box closed.

As illustrated in FIG. 3, the plurality of top panels 3 are coupled to each other by hinges 27 in such a way that the top portion 6 (as seen in FIG. 1) may be collapsed. FIG. 4 illustrates the appearance of the first embodiment when the top portion 6 (as seen in FIG. 1) is collapsed towards the front portion 21. As depicted by FIG. 5, at least one of the plurality of back panels 9 and at least one of the plurality of side panels 15 are hingedly coupled 27 in such a way that the back portion 12 and the at least one side portion 18 may be collapsed by folding the plurality of back panels 9 and the plurality of side panels 15 toward the front portion 21 (as seen in FIG. 8). At least two of the plurality of back panels 9 are detachably coupled 30 to each other with fasteners so that the user may separate the at least two of the plurality of back panels 9 from each other in order to collapse the embodiment. When collapsed, the plurality of back panels 9 and the plurality of side panels 15 are adjacent and parallel to each other as seen in FIG. 6. FIG. 6 illustrates the appearance of the first embodiment when the back portion 12 and side portions 18 are collapsed.

The first embodiment of the present invention further comprises a collapsible lockbox. FIG. 6 illustrates the appearance of the lockbox 33 when collapsed. The lockbox 33 comprises at least one side panel 34, a bottom panel 35, a lower front panel 36, an upper front panel 37 and a locking mechanism 41. The at least one side panel 34 is hingedly coupled to the front portion 21 of the convertible display fixture. The bottom panel 35 is hingedly coupled to the front portion 21 of the convertible display fixture and may be detachably coupleable to the at least one side panel 34. The lower front panel 36 is hingedly coupled to the bottom panel 35 and is also detachably coupleable to the at least one side panel 34. The upper front panel 37 is hingedly coupled to the lower front panel 36 and is coupled to a locking mechanism 41. When collapsed, the at least one side panel 34, the bottom panel 35, the lower front panel 36 and the upper front panel 37 lay flat against the front portion 21.

Figure 9:
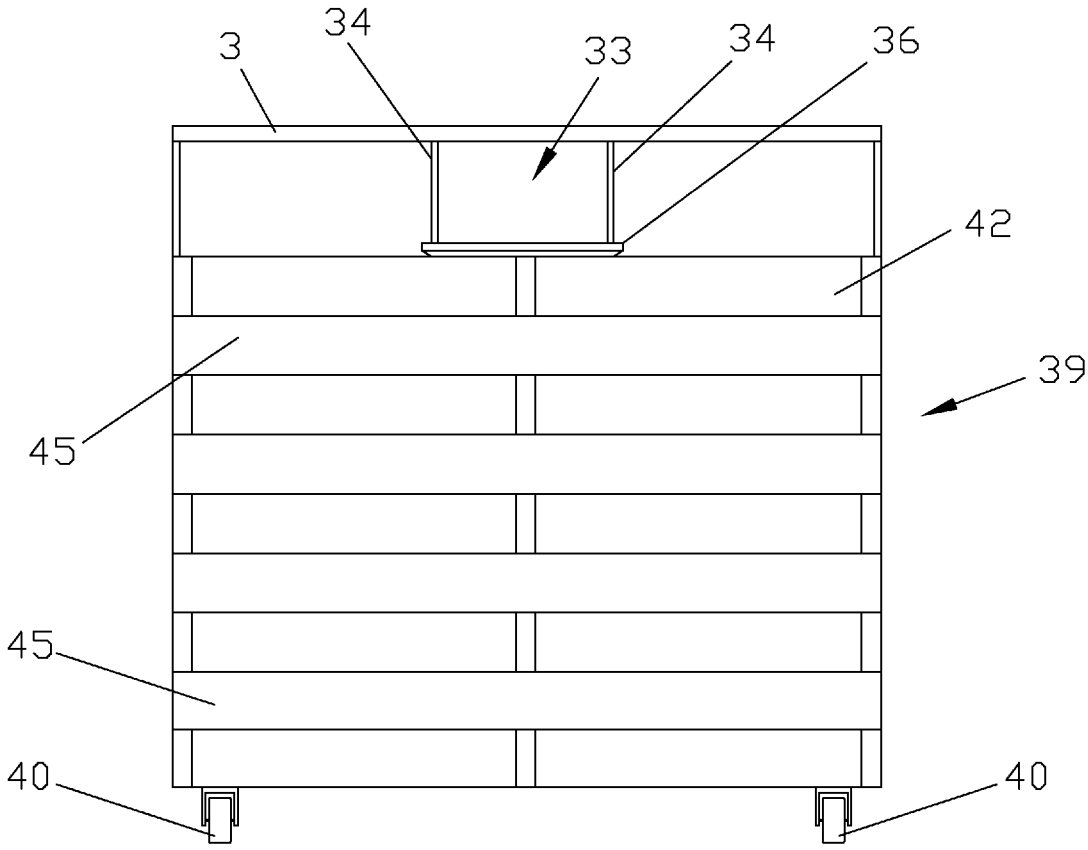
FIG. 9 is a back view of the first embodiment of a convertible display fixture configured according to an embodiment of the present invention in the display fixture configuration with the lock box open.
Figure 10:
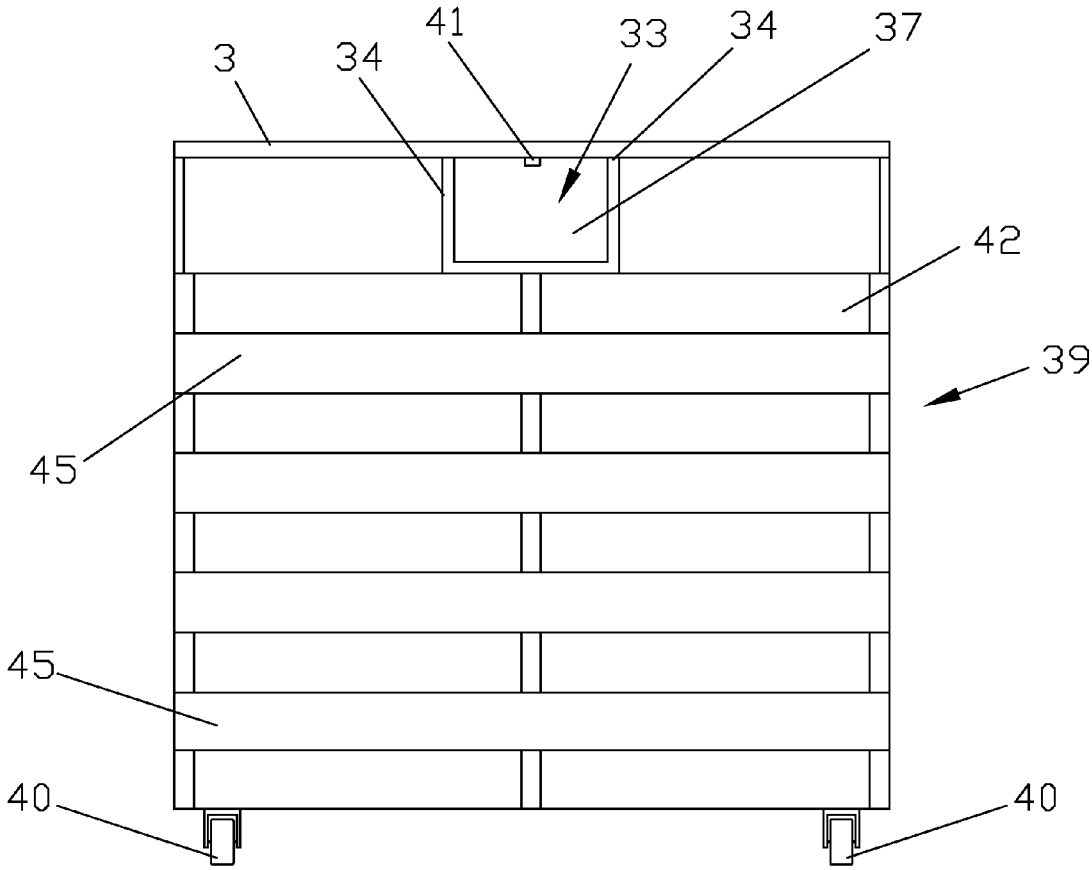
FIG. 10 is a back view of the first embodiment of a convertible display fixture configured according to an embodiment of the present invention in the display fixture configuration with the lock box closed and locked.

In an uncollapsed configuration as shown in FIG. 8, the bottom panel 35 is detachably coupled to the at least one side panel 34. Once coupled to the at least one side panel 34, the bottom panel 35 is perpendicular to the front portion 21 (See FIG. 7). The lower front panel 36 is then detachably coupled to the at least one side panel 34. The lower front panel 36 is parallel to the front portion 21 in this configuration. The upper front panel 37 can then be used to open and shut the lockbox. The upper front panel 37 is detachably coupled to at least one of the plurality of top panels 3 by the locking mechanism 41. FIG. 9 shows the lockbox 33 open. FIG. 10 illustrates the first embodiment of the present invention in display fixture configuration, with the lockbox 33 closed.

The lockbox 33 further comprises fasteners that secure the at least one side panel 34, the bottom panel 35, the lower front panel 36, and the upper front panel 37 to each other to form the assembled shape of the lockbox 33.

Alternate embodiments of the present invention do not comprise a lockbox. The lockbox 33 found in the first embodiment is a feature of the invention which may provide added convenience to the user in allowing the trade show demonstrator to store confidential items.

Figure 7:
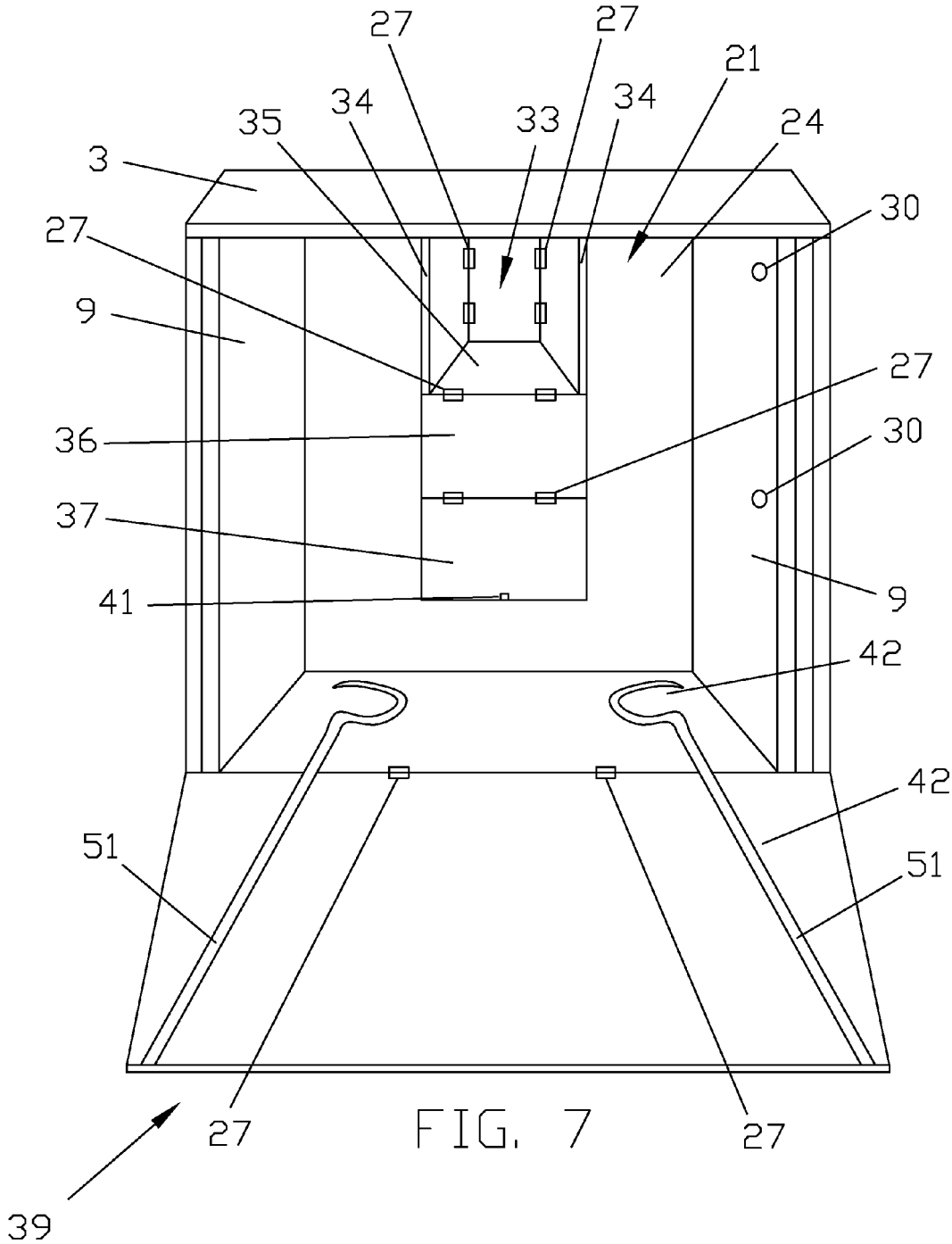
FIG. 7 is a back view of the first embodiment of a convertible display fixture configured according to an embodiment of the present invention in a display fixture configuration with the back open and lock box partially collapsed.

As shown in FIGS. 6-8, the first embodiment of the present invention further comprises a bottom portion 39. The bottom portion 39 comprises a plurality of bottom panels 42. The plurality of bottom panels 42 are hingedly coupled 27 to each other to allow one or more of the plurality of bottom panels 42 to be positioned parallel to the front portion 21 when the convertible display fixture is in the display fixture configuration. As shown in FIGS. 2, 9-11, the bottom portion 39 further comprises at least one skid 45. The at least one skid 45 is used for transporting the container by forklift or other material handling equipment. The at least one skid 45 further acts as a bumper to protect materials being transported in the convertible display fixture in shipping configuration. In FIG. 8, the bottom portion 39 is in the shipping configuration while the rest of the convertible display fixture is in display fixture configuration. FIGS. 9 and 10 illustrates the first embodiment of the present invention with one of the bottom panels 42 collapsed up to close the rear of the container and place the convertible display fixture in display fixture configuration.

As shown in FIGS. 2, 9 and 10, embodiments of a convertible display fixture configured according to the present invention may further comprise at least one wheel 40 coupled to the bottom portion 39. The at least one wheel 40 may be a wheel, coaster or the like. The at least one wheel 40 is coupled to the bottom portion 39 at the side of the bottom portion 39 where the plurality of bottom panels 42 are coupled. The at least one wheel 40 is not accessible when the convertible display fixture is in shipping configuration as shown in FIG. 2. However, when the convertible display fixture is collapsed to display fixture configuration as shown in FIGS. 9 and 10, the at least one wheel 40 is accessible and allows a user to simply lean the display fixture back onto the at least one wheel 40 in order to easily move the display fixture.

Figure 11:
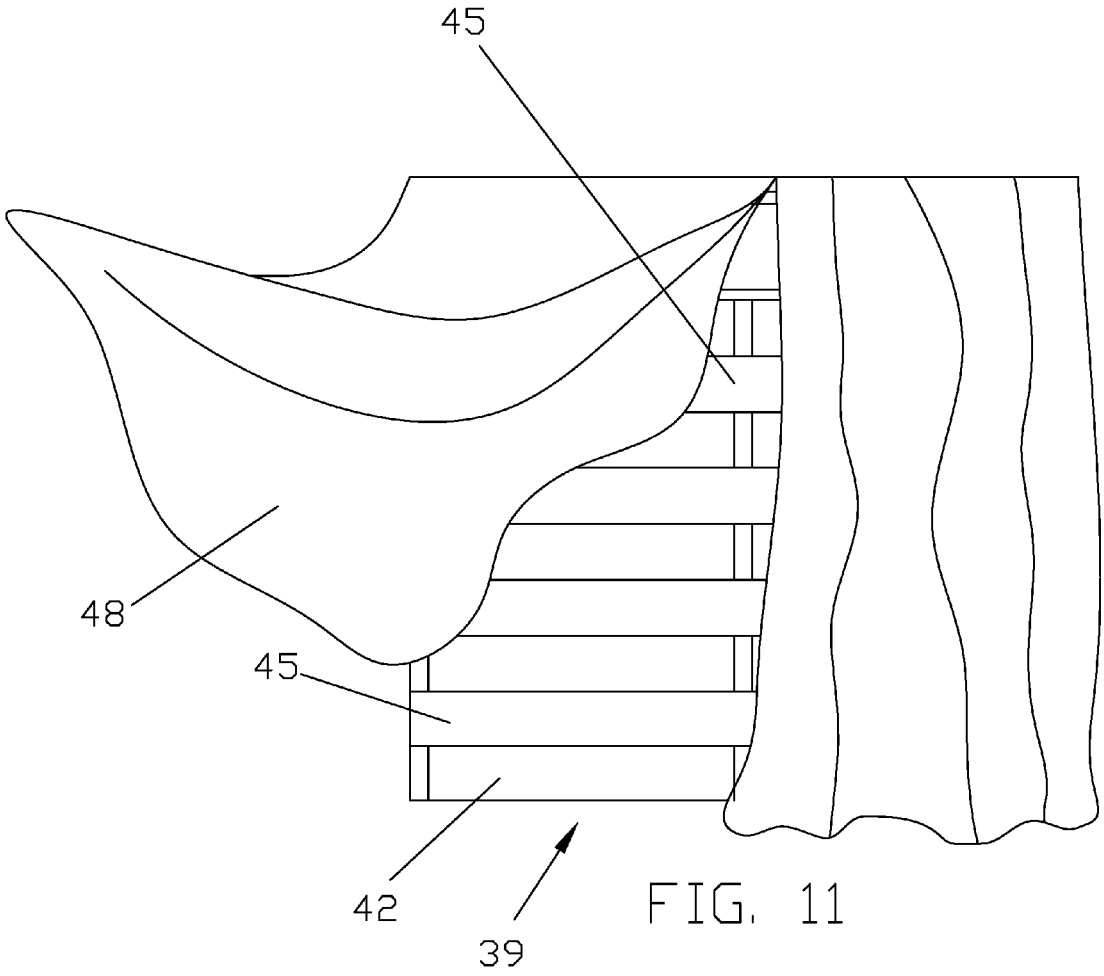
FIG. 11 is a back view of the first embodiment of a convertible display fixture configured according to an embodiment of the present invention in the display fixture configuration covered with a skirt.
Figure 12:
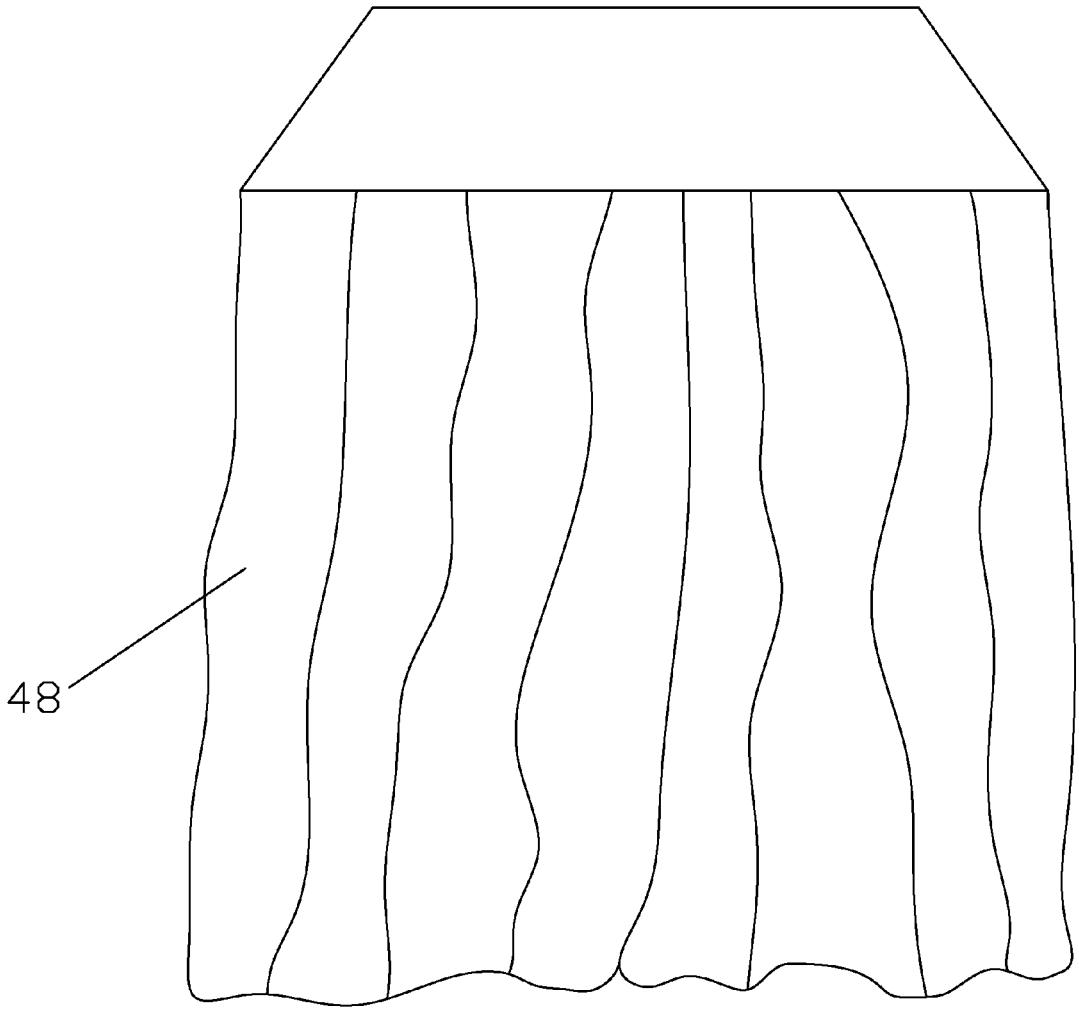
FIG. 12 is a perspective view of the front of the first embodiment of a convertible display fixture configured according to an embodiment of the present invention in the display fixture configuration covered with a skirt.

It is to be understood that in display fixture configuration, the invention may be used as a table or display stand or other fixture to support trade goods, banners, or the like. FIGS. 11 and 12 depict the first embodiment of the present invention from various angles, in display fixture configuration, covered with a skirt 48 or other decorative cover. For example, the user may cover the invention in a skirt, banner, table cloth or any other type of covering which serves their purpose. Purposes for covering the convertible display fixture in a skirt or banner may include aesthetics, advertising or the like. For example, in FIG. 11, the at least one skid 45, and the bottom portion 39 comprising the plurality of bottom panels 42 are all hidden from view by the skirt (See FIG. 12).

Locking devices such as fasteners or the like are used to secure the container in the different display fixture configurations and shipping configuration.

In alternate embodiments of the present invention, at least one of the plurality of side panels and at least one of the plurality of back panels may be detachably coupled to at least one of the plurality of top panels. At least one of the plurality of bottom panels may also be detachably coupled to at least one of the plurality of side panels and at least one of the plurality of back panels.

As shown in FIGS. 1-2 and 6-8, the first embodiment of the present invention further comprises a plurality of straps 51. The straps 51 comprise a nylon belt and a cinch. The straps 51 are used to secure the container in the shipping configuration and are fastened around the container. In alternate embodiments, the straps 51 may be made of any material that would allow them to serve the function described above. The cinches may likewise be manufactured from any material that would serve the purpose of a strap cinch or other closure.

The first embodiment of the present invention may be collapsed into a smaller configuration by virtue of its many hinged panels. Users may purchase containers of different sizes which collapse into different configurations and allow the user versatility in arranging their trade show booth.

Figure 13:
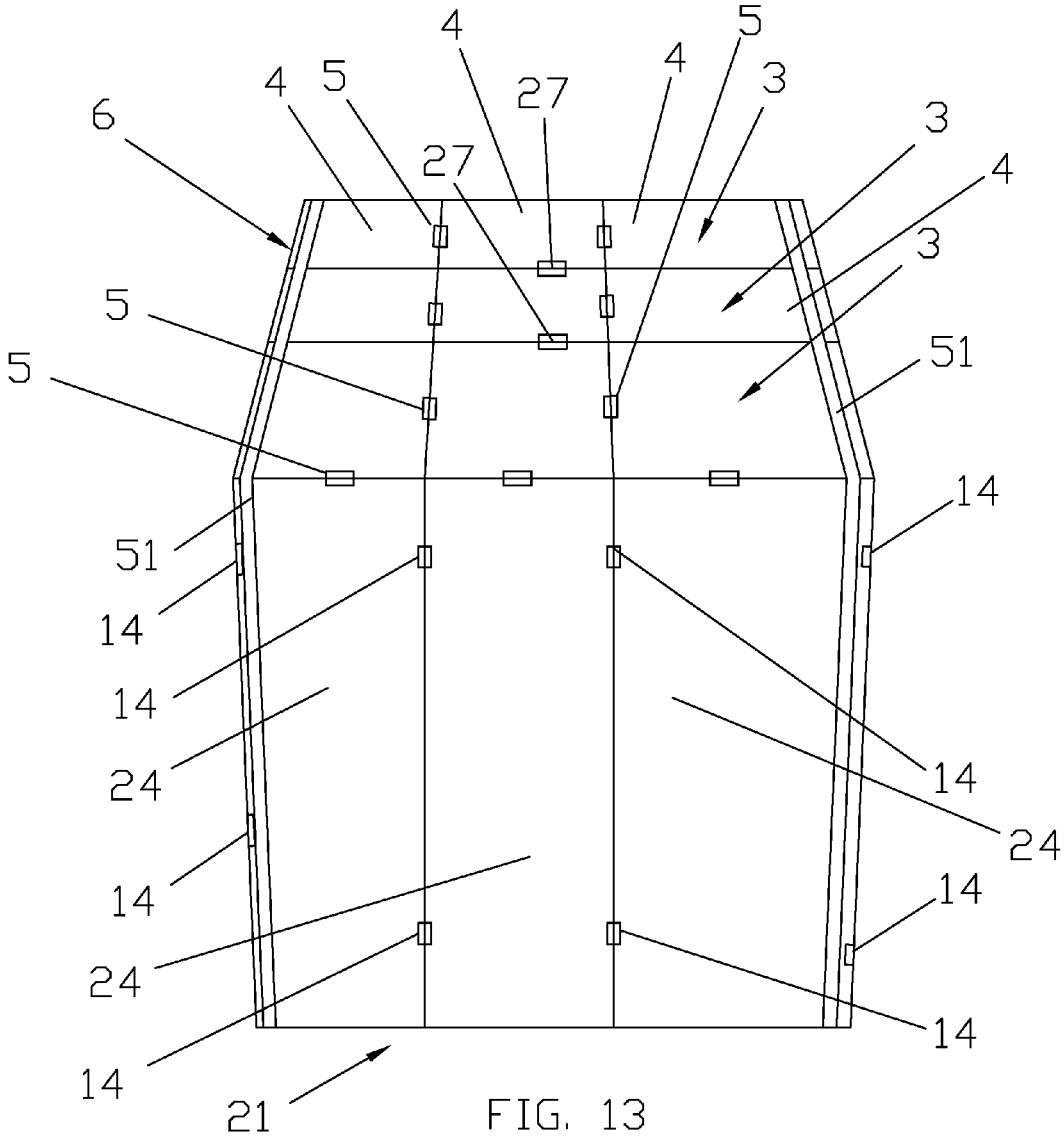
FIG. 13 is a perspective view of the front of a second embodiment of a convertible display fixture configured according to an embodiment of the present invention in a shipping configuration.

As shown in FIG. 13, alternate embodiments of the convertible display fixture may be configured in order to collapse into multiple smaller sizes and shapes for use as display fixtures. For instance, one convertible display fixture in shipping configuration may collapse into a very small cube, a larger table-like rectangle or the like. This may be accomplished by the front portion 21 comprising a plurality of front panels 24 hingedly coupled 14 together. The plurality of front panels 24 may also be detachably coupled 14 to each other or to the plurality of side panels 15 in order to allow for different configurations of the convertible display fixture in display fixture configuration. The plurality of top panels 3 which are hingedly coupled 27 may also be divided into smaller top panels 4 that are hingedly or detachably coupled 5 to each other and to the plurality of front panels 24 in order to allow the top portion 6 to have different widths also.

Alternate embodiments of the present invention, may also comprise different numbers of panels forming the portions of the container. For example, the sides may each be formed from one panel while the front and back are formed from multiple panels. It is also possible that configurations in which the top and bottom are formed from single panels while the front, back and sides are formed by multiple panels may be utilized.

Supporting devices such as brackets or the like may also be attached to the front panel in order to hold shelves for displaying goods or literature. Supporting devices such as pegs or the like may also be attached to the front panel in order to allow the user to hang items from the front panel creating a display to attract customers.

It may also be desirable, to include clips and fasteners throughout the container in order to prevent the container from collapsing while in the shipping configuration.

The first embodiment of the present invention comprises panels composed of wood, and hinges and fasteners composed of metal. In alternate embodiments of the present invention, the panels may be composed of any material or combination of materials strong enough to allow for the container to be stacked with other containers and light enough to be practical for the intended uses as demonstrated herein. Embodiments of the present invention may provide the advantage of being strong enough in any configuration to be stacked with other containers. In alternate embodiments, the hinges and fasteners are composed of any type of metal or any other material strong and practical enough to fulfill the intended purpose. In alternate embodiments, the various panels of the invention may also be trimmed with decorative and/or structural trim.

Embodiments of the present invention in shipping configuration may have a footprint of 48 inches by 48 inches, roughly equal to a standard shipping container. This size affords the benefit of being able to ship the present invention by standard shipping methods. Alternate embodiments of the present invention comprise convertible display fixtures which in shipping configuration are any size practical to use as a shipping container. It is to be understood that the present invention is intended to be not only for convertible display fixtures which expand to shipping containers but any type of similar expandable fixture or collapsible container. Similarly, the scope of the present invention is not limited to trade show display fixtures but could be adapted for any type of use involving a display fixture or a collapsible container.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A convertible display fixture comprising:

a top portion comprising a plurality of top panels hingedly coupled to each other;

a front portion comprising at least one front panel, wherein the front portion is hingedly coupled to at least one of the plurality of top panels;

at least one side portion comprising a plurality of side panels hingedly coupled to each other, wherein the at least one side portion is coupled to the front portion;

a back portion comprising a plurality of back panels coupled to each other, wherein at least one of the plurality of back panels is hingedly coupled to at least one of the plurality of side panels;

a bottom portion comprising a plurality of bottom panels hingedly coupled to each other, wherein the bottom portion is coupled to the front portion;

wherein the top portion, the at least one side portion, the back portion, the bottom portion and the front portion form a shipping container; and wherein the top portion, the at least one side portion, the back portion and the bottom portion collapse towards the front portion to form a collapsed configuration of the display fixture.

2. The convertible display fixture of claim 1, further comprising at least one skid coupled to the bottom portion.

3. The convertible display fixture of claim 1, further comprising a locking device which secures the convertible display fixture as a shipping container for transport.

4. The convertible display fixture of claim 1, further comprising a collapsible lockbox.

5. The convertible display fixture of claim 1, wherein the top portion, the at least one side portion, the back portion, the bottom portion and the front portion collapse in order to form a variety of shapes and sizes of the display fixture.

6. The convertible display fixture of claim 1, further comprising at least one strap for securing the convertible display fixture as a shipping container for transport.

7. The convertible display fixture of claim 1, further comprising at least one wheel coupled to the bottom portion.

8. A convertible display fixture comprising:

a top portion comprising a plurality of top panels hingedly coupled to each other;

a front portion comprising a plurality of front panels coupled to each other, wherein the front portion is coupled to at least one of the plurality of top panels;

at least one side portion comprising a plurality of side panels hingedly coupled to each other, wherein the at least one side portion is coupled to the front portion;

a back portion comprising a plurality of back panels coupled to each other, wherein at least one of the plurality of back panels is hingedly coupled to at least one of the plurality of side panels;

a bottom portion comprising a plurality of bottom panels hingedly coupled to each other, wherein the bottom portion is coupled to the front portion;

wherein the top portion, the at least one side portion, the back portion, the bottom portion and the front portion form a shipping container when in a shipping configuration; and wherein the top portion, the at least one side portion, the back portion, the front portion and the bottom portion collapse to form a plurality of shapes and sizes of the display fixture when in a display fixture configuration.

9. The convertible display fixture of claim 8, further comprising at least one skid coupled to the bottom portion in order to protect the convertible display fixture and materials placed in the convertible display fixture when the convertible display fixture is in the shipping configuration.

10. The convertible display fixture of claim 8, further comprising at least two of the plurality of back panels being detachably coupled.

11. The convertible display fixture of claim 8, further comprising a collapsible lockbox.

12. The convertible display fixture of claim 8, further comprising at least one locking device for securing the convertible display fixture in various configurations.

13. The convertible display fixture of claim 8, further comprising at least one strap for securing the convertible display fixture in shipping configuration for transport.

14. The convertible display fixture of claim 8, further comprising at least one skirt for covering the convertible display fixture in display fixture configuration.

15. A convertible display fixture comprising:

a top portion comprising a plurality of top panels hingedly coupled to each other;

a front portion comprising at least one front panel, wherein the front portion is hingedly coupled to at least one of the plurality of top panels;

at least one side portion comprising a plurality of side panels hingedly coupled to each other, wherein the at least one side portion is coupled to the front portion;

a back portion comprising a plurality of back panels coupled to each other, wherein at least one of the plurality of back panels is hingedly coupled to at least one of the plurality of side panels;

a bottom portion comprising a plurality of bottom panels hingedly coupled to each other, wherein the bottom portion is coupled to the front portion;

a collapsible lock box coupled to the front portion and top portion, comprising at least one side panel hingedly coupled to the front portion, a bottom panel hingedly coupled to the front portion and detachably coupleable to the at least one side panel; a lower front panel hingedly coupled to the bottom panel and detachably coupleable to the at least one side panel, an upper front panel hingedly coupled to the lower front panel, a locking mechanism coupled to the upper front panel and coupleable to the top portion;

wherein the top portion, the at least one side portion, the back portion, the bottom portion and the front portion form a shipping container when in a shipping configuration; and wherein at least the top portion, the at least one side portion, the back portion and the bottom portion collapse to form a predetermined size and shape of the display fixture when in a display fixture configuration.

16. The convertible display fixture of claim 15, further comprising at least one locking device for securing the convertible display fixture in shipping configuration.

17. The convertible display fixture of claim 15, wherein the collapsible lockbox may be utilized in both the display fixture configuration and the shipping configuration.

18. The convertible display fixture of claim 15, wherein when the convertible display fixture is in the display fixture configuration the back portion provides an opening through which the collapsible lockbox is accessible.

19. The convertible display fixture of claim 15, further comprising at least one bracket for supporting shelves to hold materials.

20. The convertible display fixture of claim 15, further comprising at least one supporting device for holding materials.

* * * * *